US010640283B2

(12) United States Patent
Kadula

(10) Patent No.: US 10,640,283 B2
(45) Date of Patent: May 5, 2020

(54) AEROSOL VALVE SYSTEM AND A CONTAINER CONTAINING SUCH AN AEROSOL VALVE SYSTEM

(71) Applicant: Wieslaw Kadula, Jaworzno (PL)

(72) Inventor: Wieslaw Kadula, Jaworzno (PL)

( * ) Notice: Subject to any disclaimer, the term of this patent is extended or adjusted under 35 U.S.C. 154(b) by 0 days.

(21) Appl. No.: 16/152,867

(22) PCT Filed: Feb. 3, 2017

(86) PCT No.: PCT/PL2017/050005
§ 371 (c)(1),
(2) Date: Oct. 5, 2018

(87) PCT Pub. No.: WO2017/180001
PCT Pub. Date: Oct. 19, 2017

(65) Prior Publication Data

US 2019/0106267 A1 Apr. 11, 2019

(30) Foreign Application Priority Data

Apr. 13, 2016 (PL) ..... 416834

(51) Int. Cl.

| | |
|---|---|
| ***B65D 83/14*** | (2006.01) |
| ***B65D 83/34*** | (2006.01) |
| ***B65D 83/68*** | (2006.01) |
| ***B65D 83/48*** | (2006.01) |
| ***B05B 15/55*** | (2018.01) |
| *B65D 83/42* | (2006.01) |
| *B65D 83/62* | (2006.01) |

(52) U.S. Cl.
CPC ..... *B65D 83/34* (2013.01); *B05B 15/55* (2018.02); *B65D 83/48* (2013.01); *B65D 83/68* (2013.01); *B65D 83/425* (2013.01); *B65D 83/62* (2013.01)

(58) Field of Classification Search
CPC ..... B65D 83/64; B65D 83/34; B65D 83/68; B65D 83/682; B65D 83/6685; B65D 83/687; B05B 15/55; B05B 15/555; B05B 15/557; B05B 15/58
USPC ..... 222/144.5, 145.1, 136, 135, 635
See application file for complete search history.

(56) References Cited

U.S. PATENT DOCUMENTS

| | | | | |
|---|---|---|---|---|
| 3,198,394 A * | 8/1965 | Lefer | ..... | B65D 83/68 222/135 |
| 3,272,387 A * | 9/1966 | Katz | ..... | B65D 83/64 222/48 |
| 3,297,209 A * | 1/1967 | Pungitore | ..... | B65D 83/44 222/132 |

(Continued)

FOREIGN PATENT DOCUMENTS

EP 2 738 117 A1 6/2014

*Primary Examiner* — Charles Cheyney
(74) *Attorney, Agent, or Firm* — Ralph E. Jocke; Colin P. Cochran; Walker & Jocke

(57) ABSTRACT

An aerosol valve system for storing and dispensing a one- or multicomponent formulation, comprising a casing (8), at least two valves (1, 1*a*, 4, 4*a*), connected to at least a first reservoir (2, 2*a*) and/or at least a second reservoir (17), respectively, wherein the first valve (1, 1*a*) comprises a stem (7), an outlet channel (3) for discharging the formulation, and a mixing chamber (3*a*), and wherein between the at least two valves (1, 1*a*, 4, 4*a*) extends a cleaning channel (6, 6*a*), connecting the second reservoir (17) to the mixing chamber (3*a*) of the first valve (1, 1*a*).

22 Claims, 6 Drawing Sheets

(56) References Cited

U.S. PATENT DOCUMENTS

| | | | | | |
|---|---|---|---|---|---|
| 3,416,709 | A * | 12/1968 | Shultz | B01F 5/0256 | 222/94 |
| 3,451,593 | A * | 6/1969 | Dillarstone | B65D 83/384 | 222/130 |
| 3,506,160 | A | 4/1970 | Forim | | |
| 3,591,054 | A * | 7/1971 | Miles | B65D 83/68 | 222/65 |
| 3,596,802 | A * | 8/1971 | Feldman | B65D 83/68 | 222/135 |
| 3,750,909 | A | 8/1973 | Butler | | |
| 3,992,003 | A * | 11/1976 | Visceglia | B65D 83/62 | 222/94 |
| 4,006,841 | A * | 2/1977 | Alticosalian | B65D 83/205 | 222/42 |
| 4,405,064 | A | 9/1983 | Stoody | | |
| 4,431,119 | A | 2/1984 | Stoody | | |
| 4,595,127 | A * | 6/1986 | Stoody | B05B 7/2421 | 222/135 |
| 5,514,026 | A * | 5/1996 | Schaffer | B24C 5/02 | 451/90 |
| 8,596,494 | B2 * | 12/2013 | Jones | B67D 1/0468 | 222/23 |
| 9,434,530 | B2 * | 9/2016 | Cornwell | B65D 83/68 | |
| 2010/0108779 | A1 * | 5/2010 | Filsouf | B05B 11/0054 | 239/61 |

* cited by examiner

AEROSOL VALVE SYSTEM AND A CONTAINER CONTAINING SUCH AN AEROSOL VALVE SYSTEM

TECHNICAL FIELD

Example arrangements relate to an aerosol valve system and a container containing such an aerosol valve system. Example arrangements are applied in a pharmaceutical, food, cosmetic, chemical industry, particularly for storing and dispending multicomponent agents that require mixing immediately before application, such as adhesives, varnishes and paints, polymer foams. Example arrangements are applied especially for gel forming in gas-gel mixing system during dispensing, BOV system water-based antiperspirants, for ointments and creams that easily undergo oxidisation.

BACKGROUND

In recent years, a dynamic development of aerosol technologies, allowing storing and administering a wide range of products, has been observed. Aerosol containers gained enormous popularity due to provided efficiency, convenience and safety of use. Generally, an aerosol container constitutes a disposable or reusable vessel, made of metal, glass, or plastic, containing pressurized, liquefied, or dissolved gas. Aerosol containers can also contain liquid, paste or powder, and are usually equipped with a dispensing device, enabling to apply the product in a form of gas suspension of solid or liquid particles, in form of a foam, paste, or powder, or in a liquid or gaseous state. A classic aerosol container contains a sprayed agent (e.g. in liquid form) and a propellant, being a fluid or gas under pressure. Triggering the aerosol valve causes opening of the valve and pushing the sprayed agent by the pressurized propellant towards the outlet, usually ended with a dispensing head, creating a finely dispersed stream.

Aerosol valve systems may benefit from improvements

BRIEF DESCRIPTION OF DRAWINGS

FIG. 8B is a transverse cross section view along line A-A in FIG. 8.

FIG. 8C is a transverse cross section view along line A-A in FIG. 8A.

DETAILED DESCRIPTION

Figure 1:
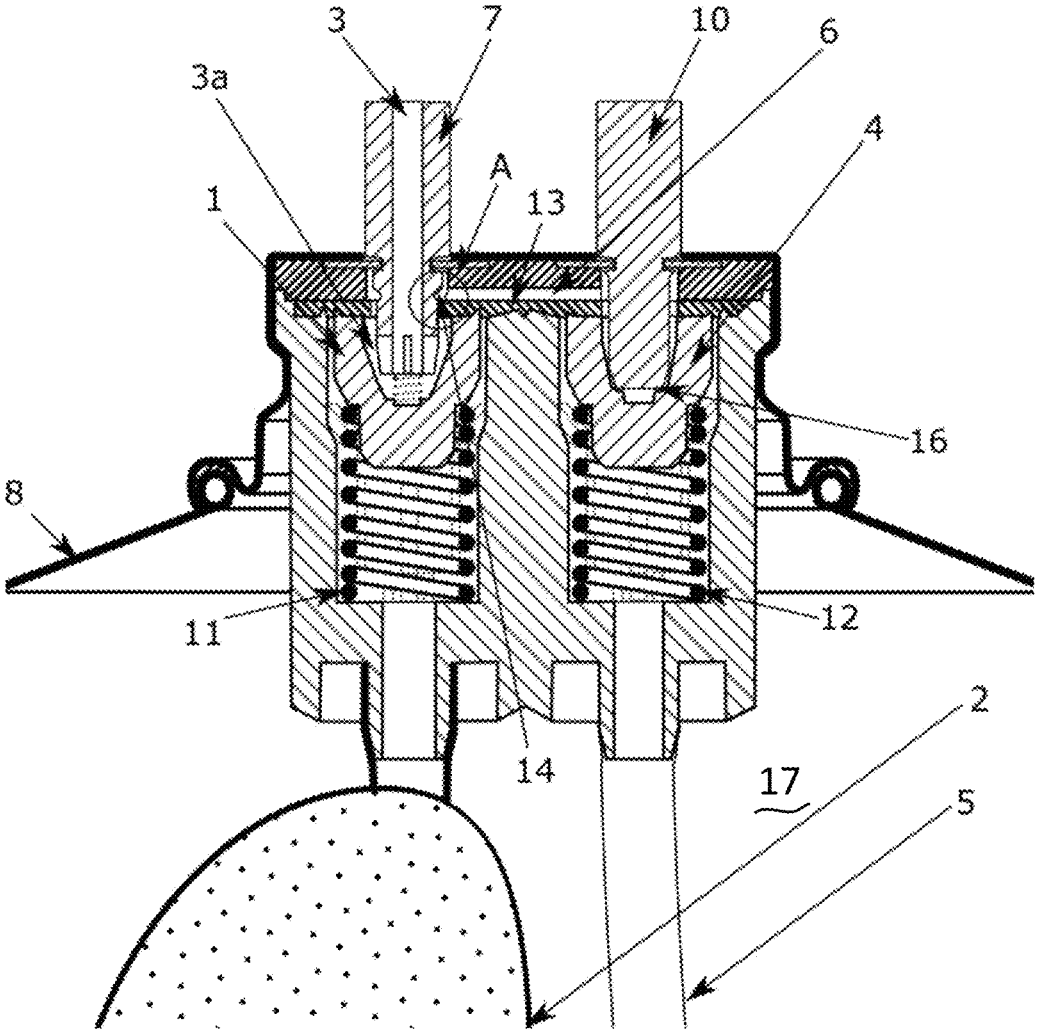
FIG. 1 is a longitudinal cross section view of a first embodiment of an aerosol valve system.

Aerosol packages gained their popularity due to a series of advantages that they offer. Products stored in aerosol packages usually display extended lifespan, mainly because of a hermetic sealing preventing the contact between the stored product and the environment, especially pollutants and microorganisms. This advantage is particularly appreciated for storing pharmaceutical agents, where maintaining maximal purity is an essential factor. It should also be noted that, in time of a rising issue of global pollution, it is desirable to use packages that are mostly suitable for recycling, which the aerosol packages undoubtedly are, since they are usually manufactured from aluminium and plastic, almost entirely suitable for reprocessing.

One of the more novel solutions that appeared in recent years in the field of aerosol industry is the 'bag on valve' technology ("BOV"). The BOV system offers significant advantages compared to the traditional aerosol valves. BOV valve system usually consists of an aerosol valve connected to a sealed bag storing the dispensed agent. The valve with the bag is placed in a can or other container and sealed by a mounting cup. This way, the dispensed agent contained in the bag is completely isolated from the propellant and they are not in direct contact. Such a valve system structure has been disclosed, among others, in a U.S. Pat. No. 4,346,743, the disclosure of which is incorporated herein by reference in its entirety. The BOV valve system offers a series of advantages that are often unobtainable in classic aerosol systems. Containing the dispensing agent in a sealed bag allows using inert gases, such as compressed air or nitrogen, as propellant, replacing toxic and flammable propellants. Moreover, contamination of the product with the propellant does not occur. Hermetic sealing of the bag, as well as the container chamber, decreases the risk of contamination of the dispensed agent. A BOV valve structure also allows dispensing at any angle and provides an almost 100% emptying of the container, positively contributing to the economic aspects.

A further improvement of a BOV aerosol valve may include incorporating two bags inside an aerosol container, which enables simultaneous dispensing of a mixture of products, contained in separate bags. Said valve system is disclosed, among others, in published European Patent Application EP2738117A1 which is incorporated herein by reference in its entirety. Such arrangement is called a Bi-Power Valve or a Multi-Bag-On-Valve ("M-BOV"). By applying at least two separate bags, it is possible to store multicomponent products that required mixing immediately before application, while maintaining the advantages of classic BOV aerosol valve systems.

With the use of M-BOV systems, the aerosol containers can be applied to storing and dispensing more sophisticated products, such as multicomponent glues, varnishes, paints that required separate storing and mixing with each other immediately before use. Such formulations have a tendency to dry out, which means that the residues located in the dispending chamber, mixing chamber and various channels leading outside the container could cause drying and clogging, and even damage of the valve system, preventing further use. In case of storing and dispensing foods, the product residues in the chambers and channels can often become spoiled, polluting the whole aerosol container. Therefore, cleaning of the valve after dispensing the one-component, as well as multicomponent, product, has become a highly significant utility issue. It is of particular importance in case of using formulations that have a tendency to dry out, oxidize, age, or are in risk of polluting, which would, after certain time, prevent further use of an unemptied container.

An aerosol valve with automatic cleaning function is known from U.S. Pat. No. 4,431,119, the disclosure of which is incorporated herein by reference in its entirety. Due to the special valve structure, three operation modes can be distinguished: closed mode, self-cleaning mode and discharging of the first and second fluid mode. The aerosol has a BOV type structure. The self-cleaning mode is executed by partially pressing the valve stem, which causes the opening of the propellant gas channel, flowing of the propellant gas into the dispensing chamber, filling it and providing its cleaning. Pressing the valve stem to the ending position also causes the opening of the second access to the dispensing chamber for the stored product, where it is mixed with the propellant gas and is discharged outside in form of a mixture. Releasing the stem induces performing of the operations in reverse order, that is closing the channel for the product to the dispensing chamber, purging the dispensing chamber with propellant gas and closing the second channel for the propellant gas. In this presented solution, the aerosol valve structure forces joint dispensing of the product and propellant gas, which limits the possible applications of the valve. Cleaning occurs each time the product is dispensed, which can cause faster depletion of the propellant gas. Moreover, the structure of the valve itself is complicated and multicomponent, being a direct cause of lower reliability and making the production process more complicated and expensive.

A similar solution is disclosed in U.S. Pat. No. 4,405,064, the disclosure of which is incorporated herein by reference in its entirety. Analogically, the disclosed valve is characterized by the BOV type structure. The aerosol valve structure allows its cleaning before and after use, i.e. before dispensing of the product and after its dispensing. Similarly, cleaning is achieved by means of partial pressing of the stem, causing opening of the propellant gas channel and purging the dispensing chamber and various channels to the dispensing head outlet. The cleaning-on-demand option is obtained by means of a rotary head with a special notch that restricts the movement of the releasing stem to a partial opening of the valve only, which causes discharging of the propellant gas only, which, at the same time, acts as a purging fluid. However, this solution does not allow dispensing of the product by itself, it is mixed with the propellant gas each time, and does not provide cleaning of all the surfaces being in contact with the product, especially of the product chamber. Analogically to the previous solution, cleaning is performed every time the product is used, which causes faster depletion of the propellant gas, whereas the aerosol valve structure is fairly complicated and multicomponent, and therefore less durable and more expensive in manufacturing.

In turn, an aerosol dispenser having a pair of fluid valves, one of which is an auxiliary valve and can be used to clean and purge the aerosol head with a dispenser nozzle, is known from U.S. Pat. No. 3,750,909, the disclosure of which is incorporated herein by reference in its entirety. The first, main valve is equipped with a classic dip tube, through which the product is extracted. After using the product, the aerosol head with the dispenser nozzle is moved to the second auxiliary valve, where, by pressing of the stem, purging of the head with a propellant gas is performed, preventing clogging or sealing of the dispenser nozzle. This solution does not allow dispensing of a multicomponent product whose components require separate storing. The cleaning function is limited only to the aerosol head and does not allow using a different cleaning agent. Executing the cleaning operation requires performing a few additional manual operations consisting of removing the head from the first valve and mounting it on a second, auxiliary valve, which negatively affects the convenience of use.

U.S. Pat. No. 3,506,160A the disclosure of which is incorporated herein by reference in its entirety discloses an aerosol valve structure directed towards a two-component or multicomponent product that requires mixing before dispensing. This aerosol valve is characterized by a simple structure, enabling forming thereof as an integral member comprising all of the valve components. The valve system comprises at least two valve triggering members, released simultaneously by a common stem. Therefore, two product components enter the mixing chamber, are mixed with each other and emerge outside the container through the common stem. Purging and cleaning the system is performed by applying a propellant entering the mixing chamber through a separate channel, this way the residues in the system, posing a potential risk of blocking and damaging the valve, are removed every time. However, there is still no possibility of cleaning the valve on demand.

An example arrangement described herein includes an aerosol valve system and a container comprising such an aerosol valve system, that will allow storing of multicomponent products, requiring mixing before dispensing, wherein the components are stored separately, particularly in separate bags in a M-BOV system. The example aerosol valve system operates to provide cleaning, purging or filling of all dispensing and mixing chambers, as well as supply and discharge channels, with an agent protecting against biological, chemical or physical factors, preventing remaining of mixed or unmixed product residues and possible damaging and/or clogging of the valve, or damaging the product itself. The example arrangement also provides 'on-demand' cleaning and realizing this function in a relatively simple manner, especially whilst using the container single-handedly. The example arrangement has a simple structure of the aerosol valve and a limited number of components, positively influencing the economic factors of the solution and its durability. Additionally, the example also includes such an aerosol valve and container comprising such an aerosol valve, in which the cleaning and purging of the valve surfaces can be achieved with any cleaning agents, even multicomponent, requiring mixing before use. Moreover, an example arrangement allows diluting the main agent with an environmentally neutral substance, and also allows packing of the formulations in an environmentally-friendly formula, limiting the use of alcohols and hydrocarbons, positively affecting the environmental factors.

The first example apparatus arrangement comprises an aerosol valve system for storing and dispensing a one- or multicomponent formulation, comprising a casing, at least two valves connected correspondingly to an at least first reservoir and/or at least a second reservoir, wherein the first valve comprises a stem, an outlet channel for discharging the formulation, and a mixing chamber. A cleaning channel connecting the second reservoir to the mixing chamber of the first valve extends between the at least two valves. In an example embodiment, the outlet channel extends along the rotational symmetry axis of the stem, forming a tubular structure. In another example embodiment the second valve comprises a closed releasing stem. In another example embodiment the valve constitutes a male or a female valve, or combinations thereof. Preferably, the stem comprises a part having a larger outer diameter and a part having a smaller outer diameter. In an example arrangement, the inner diameter of the seal is smaller than the outer diameter of the stem with a larger outer diameter and larger than the outer diameter of the stem with a smaller outer diameter. In another example arrangement, the area connecting the part with a larger outer diameter of the stem to the part with a smaller outer diameter of the stem has a tilted outer surface in relation to the rotational symmetry axis of the stem. In an example arrangement, the reservoir constitutes a bag.

Another example apparatus arrangement comprises a container for storing and dispensing a one- or multicomponent formulation, comprising an outer casing, preferably made of aluminium, and an aerosol valve system. The aerosol valve system may comprise an aerosol valve system as defined in the first example.

An example aerosol valve system allows storing and dispensing of one-component and multicomponent formulations that require mixing immediately before use, due to applying at least two valves. This approach enables the use of aerosol containers for formulations not previously stored and dispensed in this manner. In example arrangements having a second (or subsequent) valve with a connected reservoir with a cleaning agent provides a function of cleaning the aerosol valve system. Further in example arrangements, the second (or subsequent) valve is connected to the first, main valve by means of a cleaning channel connecting the second (or subsequent) valve to the mixing chamber of the first valve. This way, after releasing the second (or subsequent) valve through the stem, the cleaning agent flows from the second reservoir to the mixing chamber of the first valve and further through the intermediate channels to the stem of the first valve (or the outlet channel) and, through the head with the dispensing nozzle, outside the container. Such a flow path for the cleaning agent provides the removal of impurities and residues of the dispensed agent from all of the inner surfaces which had contact with it during the main dispensing. In this manner, a more complete removal of residues is ensured and clogging and damaging of the whole valve system is prevented. Moreover, in example arrangements when the first valve is in resting position, having a changing diameter of its stem provides a connection of the cleaning channel to its mixing chamber and outlet channel, allowing a free flow of the cleaning agent. Pressing the stem of the first valve causes the larger outer diameter to rest against the seal (having a smaller inner diameter) preventing the main agent from entering the cleaning channel during discharging of the main agent. In an example arrangement providing the second (or subsequent) valve with a reservoir with a cleaning agent, released by a separate stem, allows obtaining the effect of cleaning and purging 'on-demand' which positively affects the depletion of formulations. Moreover, placing two (or more) stems next to each other enables easy handling for the user, even while using only one hand, by which he/she could purge and clean the aerosol valve system directly after dispensing the main agent. An example M-BOV system allows using multicomponent formulations, as well as multicomponent cleaning agents, that required mixing in order to obtain the effective result. Additionally, an example arrangement enables diluting the main agent with an environmentally neutral substance; furthermore, it allows packing of the formulations in an environmentally-friendly formula, limiting the use of alcohols and hydrocarbons. It is also worth noting that the aerosol valve according to an example arrangement constitutes a structure, which positively affects the product durability and economic factors.

The principles of the example arrangements may not be limited to use of the described examples and can be applied to valves of other kinds, as well as their configurations. Other valve structures, their placement and their relative distribution (including vertical, horizontal, and diagonal configurations) known to people skilled in the art will be suitable for application of principles described herein, and the given example embodiments are not intended to limit the novel and non-obvious features described herein to the herein disclosed structures and types of valve systems.

The above discussion of apparatus of example arrangements was based on using a cleaning and purging agent for the aerosol valve system. It should be noted that other example arrangements can be applied where the residues of the formulation or formulations remaining in the channel spaces downstream from the valves have to be removed for antiseptic, sanitary, chemical (hardening of 2-component substances) or physical (drying) reasons.

EXAMPLE 1

Figure 2:
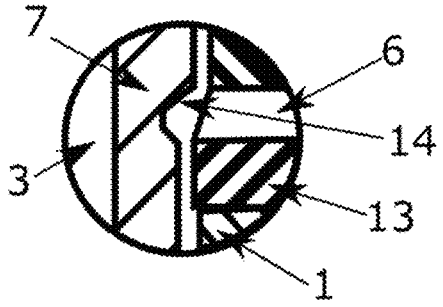
FIG. 2 is an enlarged fragmentary cross section view of Area A in FIG. 1.

The first exemplary arrangement of the aerosol valve system has been presented in a longitudinal cross-section in FIG. 1 and an enlarged fragmentary section of the detail A of the longitudinal cross-section in FIG. 2. The aerosol valve system comprises a casing 8, first reservoir 2 with a main formulation, second reservoir 17 with a cleaning (or disinfecting and/or filling) agent, first valve 1 connected to the first reservoir 2, second valve 4 connected to the second reservoir 17 by means of a dip tube 5. Valves 1 and 4 used in the present example constitute male valves. Generally, the first valve 1 comprises a mixing chamber 3*a*, and is released by a tubular stem 7 with an outlet channel 3 extending coaxially through the stem as shown. The first valve 1 is equipped with a spring 11 that holds it in a normal, closed state. The first valve 1 is connected, by means of the dip tube, with the first reservoir 2 in form of a hermetically sealed bag (of a BOV system). The second valve 4 also constitutes a male valve and generally comprises a dispensing chamber 16 and a releasing stem 10. In this case, the releasing stem 10 does not constitute a tubular structure; it is closed from the outer side of the aerosol valve system. The second valve 4 is fluidly connected to the first valve 1 by means of a cleaning channel 6 that is connected to the mixing chamber 3*a* of the first valve 1. After pressing the stem 7 of the first valve 1, the main agent located in the first reservoir 2 flows to the mixing chamber 3*a* and further, through the outlet channel 3, outside the container (usually through a head with a dispensing nozzle, not shown). Thus the mixing chamber 3*a* is fluidly intermediate of the first reservoir and the outlet channel as shown. Releasing the pressing force causes an automatic closing of the first valve 1 (the expanding biasing action of the spring 11). The example stem 7 has an outer diameter that varies along the rotational axis, i.e. the part of the stem 7 facing towards the outside of the container has a larger outer diameter, whereas the part of the stem 7 facing towards the inside of the container has a smaller outer diameter (the area where variation of the outer diameter of stem 7 occurs has been shown in enlarged fragmentary section in FIG. 2, where a tilted outer surface 14 of the transition area between the larger and smaller outer diameter parts of the stem 7 is especially distinguished). As shown in the attached FIG. 2, the part of the stem 7 facing towards the outside of the container has a larger outer diameter than the inner diameter of the seal 13. Whereas the part of the stem 7 facing towards the inside of the container has a smaller outer diameter than the inner diameter of the seal 13. This way, in a normal position of the first valve 1, there is a free fluid connection between the cleaning channel 6, the mixing chamber 3*a* and the vertical outlet channel 3, which enables a free flow of the cleaning agent after releasing the second stem 10. After pressing the stem 7, its tilted outer surface 14 (tilted in relation to the rotation axis of the stem 7), pushing against the seal 13, causes closing of the cleaning channel 6 and prevents the main agent from flowing into the cleaning channel 6, increasing the whole systems durability and decreasing the clogging risk. After pressing the first stem 10 of the second valve 4, the cleaning agent located in the second reservoir 17, connected by the dip tube 5, is extracted from the second reservoir 17, flows to the dispensing chamber 16 of the second valve 4, and then through the cleaning channel 6, to the mixing chamber 3*a* of the first valve 1, and further through the outlet channel 3 of the stem 7 of the first valve 1, outside the container. In this manner, all of the inner surfaces of the mixing chamber 3*a* and the outlet channel 3 are subjected to residue removal and cleaning, which ensures a lack of clogging and damaging risk of the aerosol valve system. Additionally, the tilted outer surface 14 of the transition area of the stem 7 provides a better sealing between the part of the stem 7 characterized by a larger outer diameter and the seal 13, fitting to the elastic deformation of the seal itself as a result of pressing of the stem 7.

Useful aspect of the example aerosol valve system presented in FIG. 1, in which the first reservoir 2 constitutes the bag, and the second reservoir 17 constitutes the inside of the aerosol container, is a possibility of pregasing the aerosol container through the outlet channel 3 and cleaning channel 6 without the need to lift up the casing of valves 1 and 4, which results in decreasing the gas discharge. Moreover, it is possible to apply this solution to pregasing the containers with liquid gas, e.g. propane/butane, which can be a propellant, as well as a cleaning agent. In case of the example aerosol valve system presented in FIG. 1, in which both the first reservoir 2 and the second reservoir 17 constitute bags (BOV), pregasing of the reservoirs 2 and 17 is realized by lifting up the casing of valves 1 and 4. In this state, propellant gas is introduced, in form of air, nitrogen or other compressed gas, into the aerosol container. After obtaining pressure in the aerosol container, the casing of valves 1 and 4 is closed. The active substance is introduced through the outlet channel 3 of stem 7, by pressing it, which causes the opening of valve 1 and introducing the active substance into the first reservoir 2 (a bag). The next step involves filling the second reservoir 17 (which may compromise a bag) with a cleaning (or washing, disinfecting) substance, used to clean the outlet channel 3, mixing chamber 3*a* and valve 1. This substance is introduced through the outlet channel 3 of the stem 7, which is in neutral position, and by using the cleaning channel 6. Access to the second reservoir 17 is provided by pressing the releasing stem 10.

EXAMPLE 2

Figures 3, 3A:
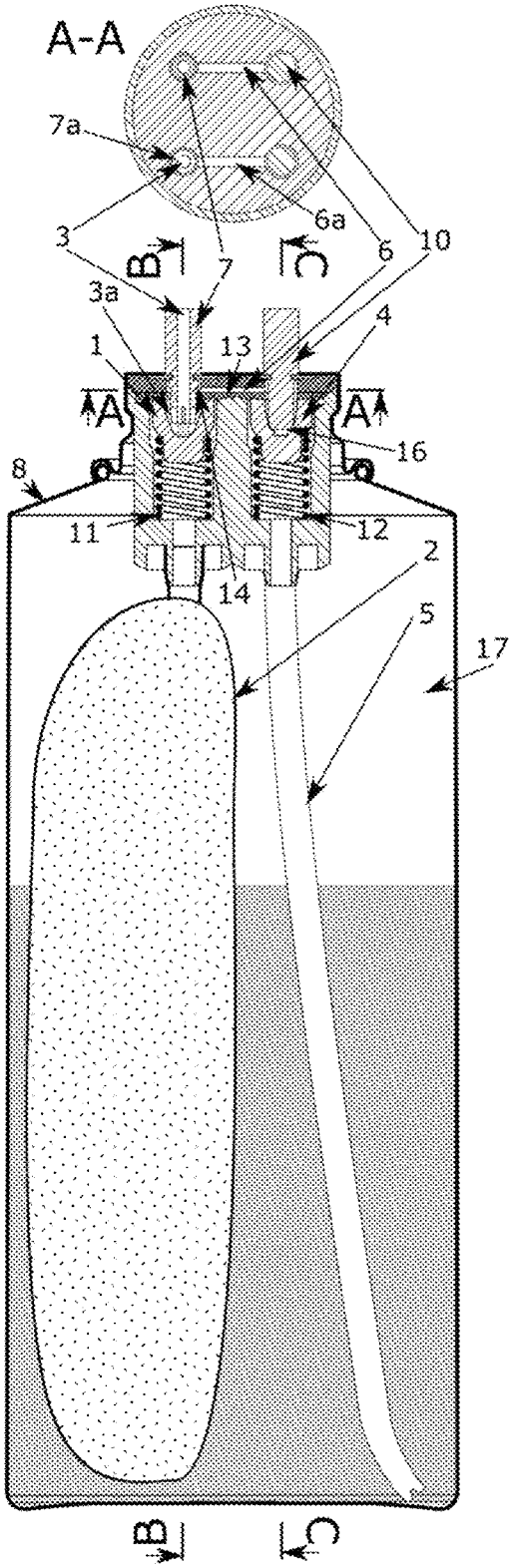
FIG. 3 is a longitudinal cross section view of a second embodiment of an aerosol valve system.
FIG. 3A is a transverse cross section view along line A-A in FIG. 3.
Figure 4:
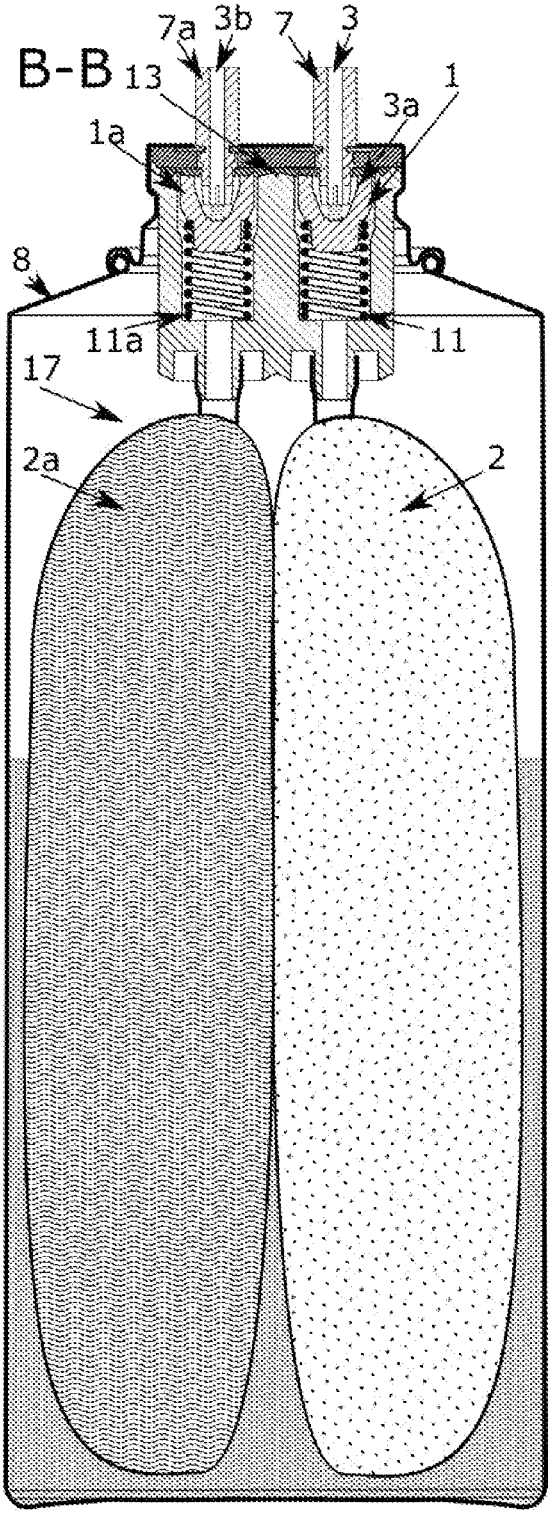
FIG. 4 shows a longitudinal cross section view along line B-B in FIG. 3.
Figure 5:
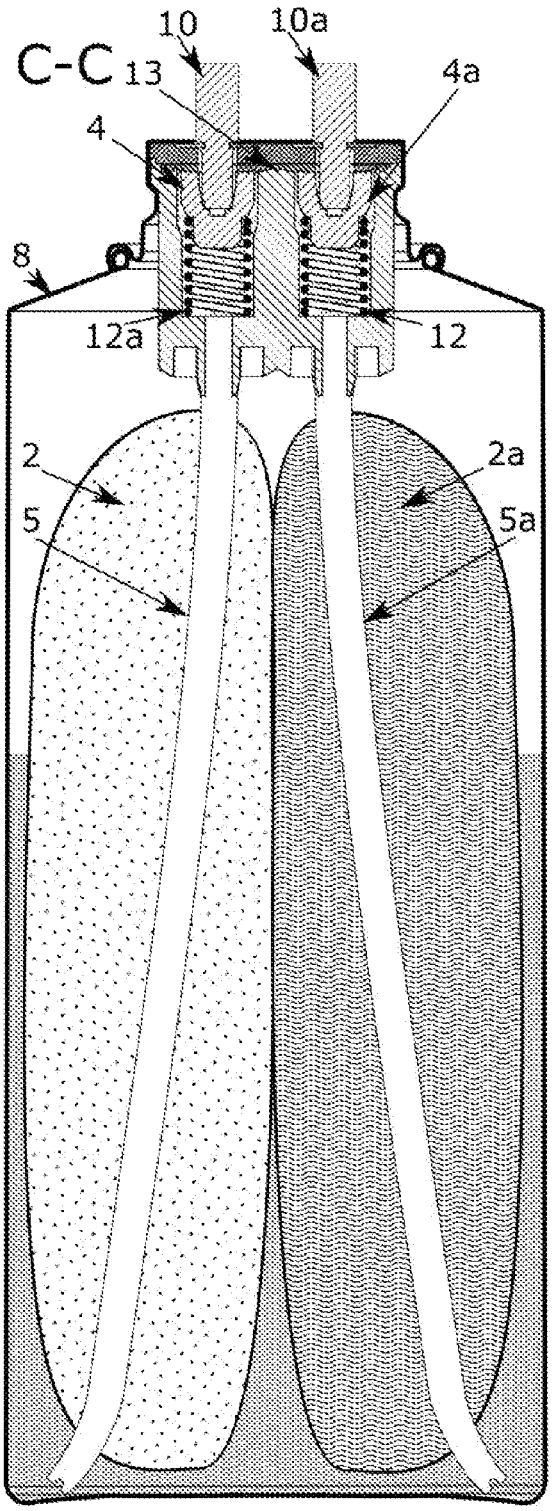
FIG. 5 shows a longitudinal cross section view along line C-C in FIG. 3.

The second example of an aerosol container and the aerosol valve system has been illustrated in a longitudinal cross-section in FIG. 3, where in FIG. 3*a* a transverse cross-section along the A-A plane is additionally illustrated. Additionally, for more accurate presentation of this example, in FIG. 4 and FIG. 5, longitudinal cross-sections of the aerosol container of FIG. 3, made along the B-B and C-C plane, have been respectively presented. The aerosol valve system constitutes an analogical structure to that presented in example 1, with the difference that two pairs of the first valves 1 and 1*a*, and second valves 4 and 4*a*, connected with two cleaning channels 6 and 6*a*, are used. Such structure is envisioned in application for two-component formulations that require storing in separate, sealed reservoirs 2 and 2*a*, and either are dispensed one after another (e.g. agent A first, then agent B), or are mixed in a special dispensing head (not shown) and dispensed as a mixed product (e.g. agent A+B). Valves 1 and 1*a* are connected to reservoirs 2 (agent A) and 2*a* (agent B), respectively. After using these valves, cleaning of their channels is performed by the second valve pair 4 and 4*a* connected to a common reservoir 17 containing the cleaning agent, through the corresponding dip tubes 5 and 5*a*. In this particular example, independent cleaning of valves 1 and 1*a* is provided, after using each of them separately, by applying separate cleaning channels 6 and 6*a*. In this case the stems 7 and 7*a* releasing the main agents have coaxial outlet channels 3 and 3*b*, respectively. Analogically to the example 1, valves 1 and 1*a* are kept in normal, closed position due to expanding action of the springs 11 and 11*a*. Stems 10 and 10*a*, releasing the cleaning agent, are similarly closed from the outer side of the aerosol valves system. Valves 4 and 4*a* are biased toward the normally closed state by springs 12 and 12*a* respectively as shown in FIG. 6. Additionally, according to the structure presented in the first example, stems 7 and 7*a* have a varying outer diameter along their length, by which closing of the corresponding cleaning channels 6 and 6*a* is provided by pressing the stems 7 and 7*a*, causing pushing of the transition area with varying outer diameter (especially the tilted surface 14) against the corresponding openings in the seal 13. This way, an increased durability of the presented aerosol valves system is obtained.

EXAMPLE 3

Figure 6A:
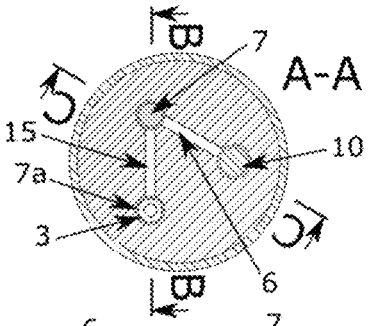
FIG. 6*a* is a transverse cross section view along line A-A in FIG. 6.
Figure 6:
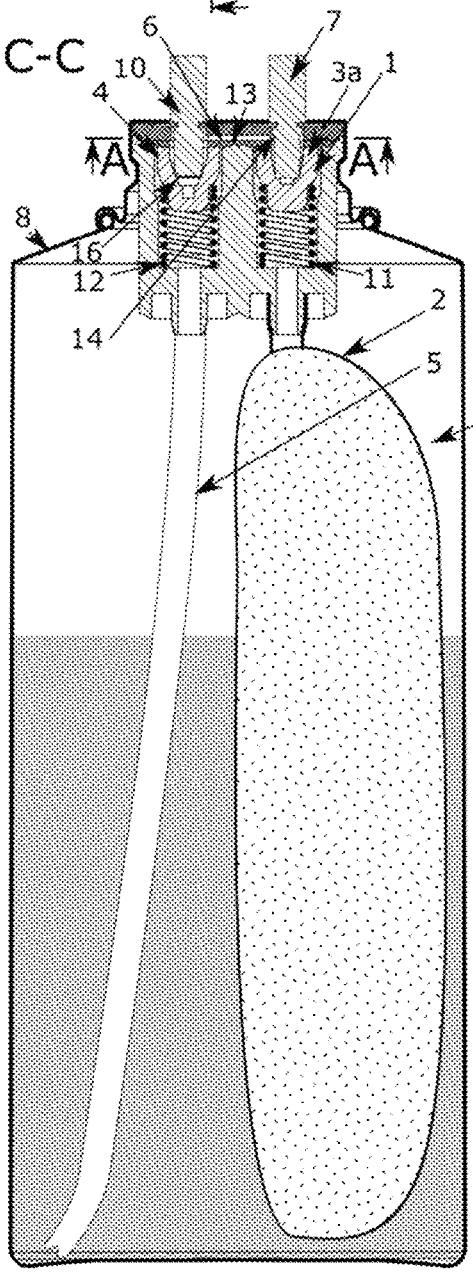
FIG. 6 shows a longitudinal cross section view of a third embodiment of an aerosol valve system.
Figure 7:
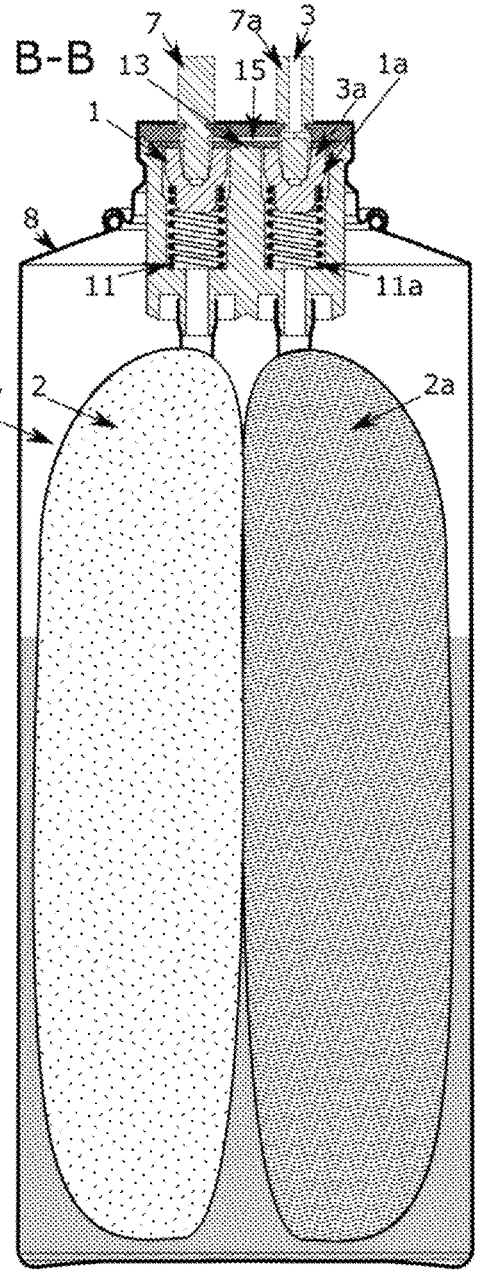
FIG. 7 is a longitudinal cross section view along line B-B in FIG. 6.

Another example arrangement has been illustrated in longitudinal cross-sections in FIGS. 6, 6*a* and 7. Generally, the structure of the aerosol valves system is analogical to the structure shown in example 2. The main difference is the fact that in example 2 the valves system enabled dispensing of separately stored components in a 'one after another' option (agent A first, agent B next or vice versa) or in a 'mixed components' option, wherein the mixing is achieved in the dispensing head, not shown on figures. In the third example, components stored in separate reservoirs 2 and 2*a* can be mixed inside the aerosol valves system and can leave the aerosol valves system in mixed form, or can be dispensed separately. As shown more precisely in transverse cross-section A-A in FIG. 6*a*, for this reason an aerosol valve system was provided, equipped with three valves: valve 1 for agent A stored in reservoir 2, a second valve 1*a* for agent B stored in reservoir 2*a*, and a third valve 4 for the cleaning agent stored in reservoir 17. Each of the valves 2, 2*a* and 4 is equipped with a stem, 7, 7*a* and 10, respectively, wherein stem 7*a* constitutes a tubular stem with an outlet channel 3 extending coaxially. An additional dispensing channel 15, connecting the corresponding mixing chambers 3*a*, extends between valve 1 for the agent A and valve 1*a* for the agent B. In turn, a cleaning channel 6, providing cleaning of the whole aerosol valve system, extends between valve 1 and valve 4. By pressing stem 7*a*, only agent B is dispensed, by pressing steam 7, only agent A is dispensed, which flows through the mixing chamber of valve 1, and then trough the dispensing channel 15, mixing chamber 3*a* of valve 1*a* and the outlet channel, outside the container. Simultaneous triggering of stems 7 and 7*a* causes mixing of agent A and agent B in the mixing chamber 3*a* of valve 1*a*, and releasing agent A mixed with agent B outside the container. Then, the mixing chamber 3*a* of valve 1*a* and the outlet channel 3 are in contact with the mixed substance, whereas the mixing chamber of valve 1 and dispensing channel 15 are in contact with agent A only. After finished dispensing of the main agents, pressing of stem 10 triggers the valve 4 and causes releasing of the cleaning agent. Cleaning agent of reservoir 17 flows through the dip tube 5 to the dispensing chamber 16 of valve 4, and then through the cleaning channel 6 to the mixing chamber of valve 1, and further through the dispensing channel 15 to the mixing chamber 3*a* of valve 1*a*, and through the outlet channel 3, to discharge outside the container. In this manner, the cleaning agents comes in contact with all inner surfaces of channels and chambers, which were in contact with the mixed agent in form of mixed agents A and B, as well as all inner surfaces of channel and chambers, which were in contact with agent A only. This way, cleaning of all inner surfaces, which were in contact with the main agents, is provided, enabling avoiding the clogging of individual channels and chambers, and their contamination. Simultaneous pressing of stems 7 and 7*a* can be achieved by a head designed especially for this purpose (not shown).

EXAMPLE 4

Figure 8:
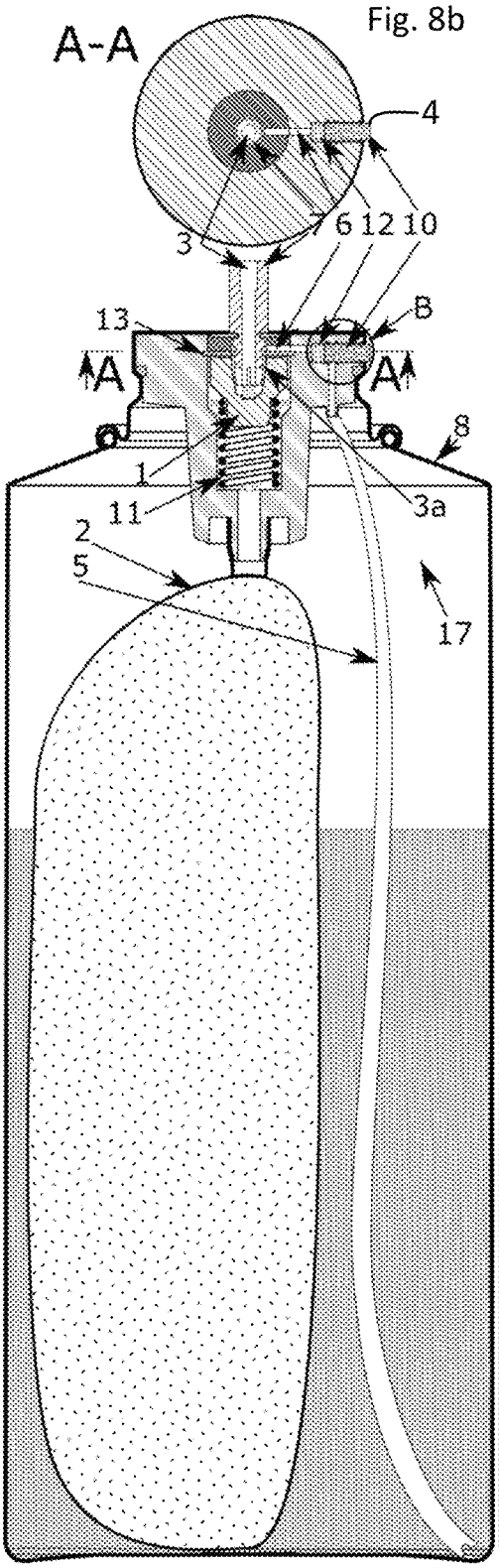
FIG. 8 is a longitudinal cross section view of a fourth embodiment of an aerosol valve system used in connection with the first container configuration
Figure 8A:
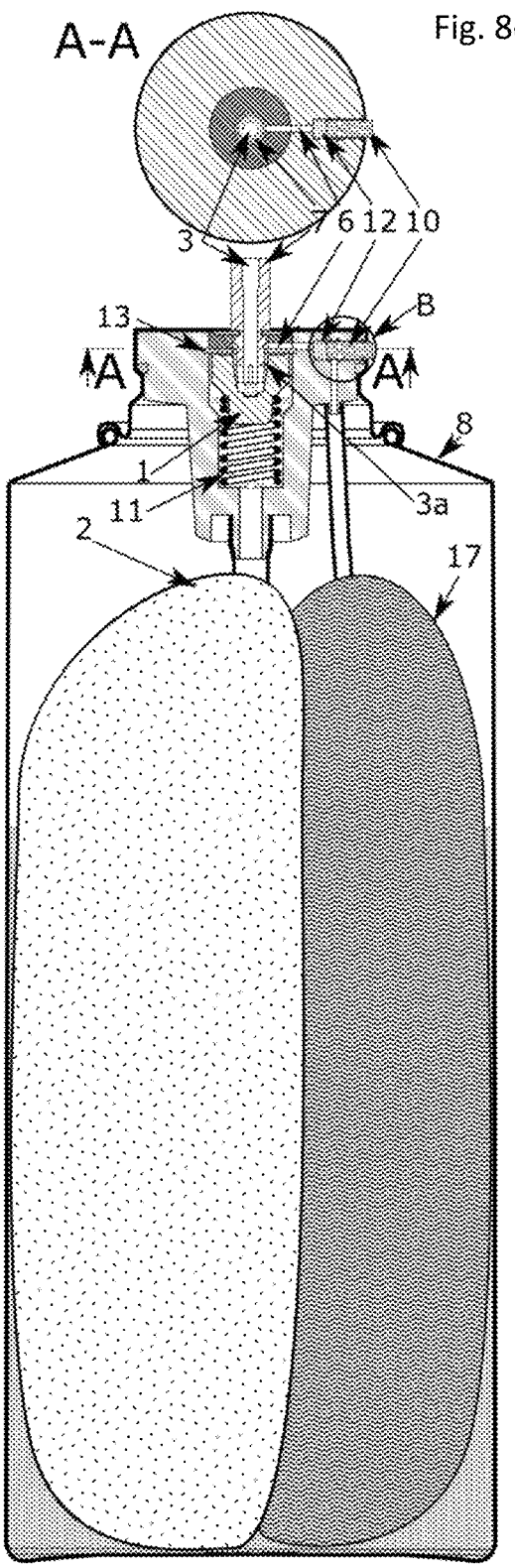
FIG. 8A is a longitudinal cross section view of the fourth embodiment of an aerosol valve system used in connection with a second container configuration.
Figure 9:
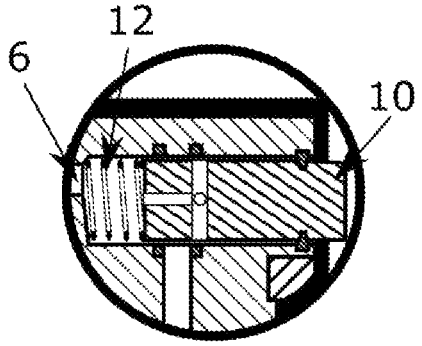
FIG. 9 is an enlarged fragmentary cross section view of Area B in FIGS. 8 and 8A.

The next example arrangement has been illustrated in a longitudinal cross-section and a transverse cross-section along the A-A plane, in FIG. 8 and FIG. 8*b*. In the arrangement presented in FIGS. 8 and 8*b*, the cleaning formulation is located directly in the container constituting the second reservoir 17. In FIG. 8*a* and FIG. 8*c*, an alternative realization of the arrangement has been presented, wherein the cleaning formulation is located in the second reservoir 17 constituting a bag. FIG. 9 shows an enlarged fragmentary section of the detail B of FIG. 8. The presented arrangement constitutes an alternative structure of the aerosol valve system shown in example 1. The fundamental difference distinguishing the aerosol valve system structures is the placement of the second valve 4. In example 1, valves 1 and 4 were placed in a vertical array, beside each other in such a way that the corresponding stems 7 and 10 were parallel to each other. In example 4, the second valve 4 is located perpendicularly to the first valve 1, and consequently, the corresponding stems 7 and 10 also extend perpendicularly to each other. As a result, the distal end of stem 7 of valve 1 is located in the upper part of the aerosol valve system, whereas the distal end of stem 10 of valve 4 is located in the side part of the aerosol valve system, perpendicularly to stem 7. The principle of operation of the aerosol valve system shown in FIGS. 8, 8*a*, 8*b*, 8*c* and 9 coincides with that of example 1. The valve 4 structure has been presented in detail, in an enlarged fragmentary section of area B, in FIG. 9. It constitutes a male valve structure, released by a closed stem 10, held in normal, closed state by the spring 12. This example embodiment of valve 4 required creating an additional channel in the aerosol valve system that provided a fluid connection with the second reservoir 17 through the dip tube 5. The solution presented in this example, due to using the valve 1 that is coaxial with the aerosol container, does not require positioning of the head in relation to the valve, during filling and pregasing, and allows applying previously used packaging lines for aerosol valves system manufacture, if a small modification is applied, while maintaining all of the advantages of the example aerosol valves system mentioned in the present description.

For all of the examples presented in the present description different methods of filling may be used. Such methods were described in detail for example 1 only.

Thus the example arrangements described herein achieve improved operation, eliminate difficulties encountered in the use of prior aerosol valve devices and systems, and attain the useful results described herein.

In the foregoing description certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful concepts are not limited to the exact features shown and/or described.

It should further be understood that the features and/or relationships associated with one example arrangement can be combined with features and/or relationships from other example arrangements. That is, various features and/or relationships from various sample arrangements can be combined in further arrangements. The new and useful scope of the disclosure is not limited to only the example arrangements shown and described.

Having described features, discoveries and principles of the example arrangements, the manner in which they are constructed and operated, and the advantages and useful results attained; the new and useful features, devices, elements, arrangements, parts, combinations, systems, equipment, operations, methods, processes and relationships are set forth in the appended claims.

The invention claimed is:

1. Apparatus comprising:

an aerosol valve system including:

a container, wherein the container houses a first reservoir, and a second reservoir, wherein the first reservoir is fluidly separated within the container from the second reservoir, wherein the first reservoir houses a first material, and the second reservoir houses a second material that is different from the first material and which acts as a cleaning agent with respect to the first material, a first valve, wherein the first valve is selectively changeable between a first valve open state and a first valve closed state, wherein the first valve is fluidly connected with the first reservoir within the container, wherein the first valve includes an axially extending first valve stem, wherein the first valve stem includes an axially extending outlet channel, wherein the first valve is operative to discharge the first material through the outlet channel when the first valve is in the first valve open state, a mixing chamber, wherein the mixing chamber is fluidly intermediate of the first reservoir and the outlet channel, a second valve, wherein the second valve is selectively changeable between a second valve open state and a second valve closed state, wherein the second valve is fluidly connected with the second reservoir within the container, a cleaning channel, wherein the second valve is in fluid connection with the cleaning channel and is operative to discharge the second material to the cleaning channel in the second valve open state, wherein the cleaning channel is in fluid connection with the mixing chamber of the first valve, wherein the first valve in the first valve open state is operative to discharge the first material through the outlet channel, and wherein after the first valve is changed from the first valve open state to the first valve closed state, the second valve is enabled to be in the second valve open state, whereby in the second valve open state the second material flows through the cleaning channel, the mixing chamber and the outlet channel to clean the first material therefrom.

2. The apparatus according to claim 1 wherein the mixing chamber extends in surrounding relation of the first valve stem.

3. The apparatus according to claim 2 wherein the first valve includes a first valve spring, wherein the first valve spring is in operative connection with the first valve stem, wherein the first valve is changeable between the first valve open state and the first valve closed state through axial movement of the first valve stem, wherein the first valve spring is operative to bias the first valve stem toward the first valve closed state.

4. The apparatus according to claim 3 wherein the second valve includes a second valve stem, wherein the second valve stem extends along a further axis, a second valve spring, wherein the second valve spring is in operative connection with the second valve stem, wherein the second valve is changeable between the second valve open state and the second valve closed state responsive to further axial movement of the second valve stem, wherein the second valve spring is operative to bias the second valve stem toward the second valve closed state.

5. The apparatus according to claim 4 wherein each of the first valve stem and the second valve stem are configured to be changeable between the first valve open state and the first valve closed state and the second valve open state and the second valve closed state respectively, via single hand operation.

6. The apparatus according to claim 5 wherein the axis of the first valve stem and the further axis of the second valve stem extend either parallel to one another or perpendicular to one another.

7. The apparatus according to claim 6 wherein the second valve stem comprises a closed releasing stem.

8. The apparatus according to claim 7 wherein the first valve includes a seal, wherein the seal extends in surrounding relation of the first valve stem, wherein in the first valve open state the seal is operative to fluidly separate the cleaning channel from the first material.

9. The apparatus according to claim 8 wherein the first valve stem includes a relatively larger outer diameter part and a relatively smaller outer diameter part, wherein the relatively smaller outer diameter part is axially disposed from the relatively larger outer diameter part, wherein in the first valve open state the relatively larger outer diameter part is in engagement with the seal, wherein such engagement fluidly separates the cleaning channel from the first material.

10. The apparatus according to claim 9 wherein in the first valve open state the relatively larger outer diameter part in engagement with the seal fluidly separates the cleaning channel and the mixing chamber.

11. The apparatus according to claim 10 wherein the seal includes an inner diameter, wherein in the first valve closed state the relatively larger outer diameter part is axially disposed from the seal and the relatively smaller outer diameter part extends through the inner diameter of the seal, and the cleaning channel is in fluid connection with the mixing chamber through the inner diameter of the seal.

12. The apparatus according to claim 11 wherein the relatively larger outer diameter part and the relatively smaller outer diameter part are connected on the stem through a tilted outer surface that extends on the first valve stem between the relatively larger outer diameter part and the relatively smaller outer diameter part.

13. The apparatus according to claim 12 wherein the container houses a third reservoir, wherein the third reservoir is fluidly separated in the container from the first reservoir and the second reservoir, wherein the third reservoir houses a third material that is different from the first material and the second material, and further comprising:

a third valve, wherein the third valve is selectively changeable between a third valve open state and a third valve closed state, wherein the third valve is in fluid connection with the mixing chamber through a dispensing channel, wherein in the third valve open state the third material is delivered to the mixing chamber through the dispensing channel and the third material is discharged from the outlet channel.

14. The apparatus according to claim 13 wherein the second valve is in fluid connection with the third valve, wherein in the third valve closed state and in the second valve open state, the second material is caused to flow through the third valve and the dispensing channel to clean the third material therefrom.

15. The apparatus according to claim 14 wherein the third valve and the distribution channel are fluidly intermediate of the second valve and the first valve.

16. The apparatus according to claim 15 wherein at least one of the first reservoir, the second reservoir and the third reservoir include a bag within the container.

17. The apparatus according to claim 1 wherein the first valve and the second valve are configured to be changeable between the first valve open state and the first valve closed state, and the second valve open state and the second valve closed state respectively, through single hand operation.

18. The apparatus according to claim 1 wherein the first valve includes a seal having an inner diameter, wherein the first valve stem includes a relatively smaller outer diameter part and a relatively larger outer diameter part axially disposed from the relatively smaller outer diameter part, wherein the relatively smaller outer diameter part of the first valve stem extends in the inner diameter of the seal and is axially movable therein, wherein in the first valve open position the relatively larger outer diameter part is in engagement with the seal, wherein such engagement fluidly separates the cleaning channel and the mixing chamber, whereby the first material is prevented from entry to the cleaning channel.

19. Apparatus comprising:

an aerosol valve system including a container housing fluidly separated first and second reservoirs, wherein the first reservoir is configured to house a first material ii and the second reservoir is configured to house a second material that is a cleaning agent with respect to the first material, a first valve, wherein the first valve is fluidly connected to the first reservoir within the container, wherein the first valve is hand actuatable between a first valve open state and a first valve closed state, wherein in the first valve open state the first valve is operative to discharge the first material from the first valve, a second valve, wherein the second valve is fluidly connected to the second reservoir in the container, wherein the second valve is hand actuatable between a second valve open state and a second valve closed state, wherein in the second valve open state the second valve is operative to discharge the second material to a cleaning channel, wherein the cleaning channel is fluidly connected to the first valve, wherein in the second valve open state and the first valve closed state, the second material is discharged through the first valve, whereby the first material is cleaned from the first valve by the discharged second material, and wherein in the first valve open state and in the second valve closed state, the first valve is operative to discharge the first material through the first valve.

20. The apparatus according to claim 19 wherein the first valve comprises a first axially movable first valve stem, wherein the first axially movable first valve stem includes an axially extending outlet channel extending therethrough, wherein the first valve includes a mixing chamber, wherein the mixing chamber extends in surrounding relation of the first valve stem, wherein in the first valve open state the mixing chamber is in fluid connection with the first reservoir and the outlet channel from which the first material is discharged, and wherein in the first valve closed state the mixing chamber is fluidly separated from the first reservoir and is in fluid communication with the cleaning channel.

21. Apparatus comprising:

an aerosol valve system including a container housing fluidly separated first and second reservoirs, wherein the first reservoir is configured to house a first material and the second reservoir is configured to house a second material that is a cleaning agent with respect to the first material, a first valve, wherein the first valve comprises a first axially movable first valve stem, wherein the first axially movable first valve stem includes an axially extending outlet channel extending therethrough, wherein the first valve further includes a mixing chamber, wherein the mixing chamber extends in surrounding relation of the first valve stem, wherein the first valve is operatively fluidly connected to the first reservoir, wherein the first valve is hand actuable between a first valve open state and a first valve closed state, wherein in the first valve open state the first valve is operative to discharge the first material from the first valve through the outlet channel, wherein in the first valve open state the mixing chamber is in fluid connection with the first reservoir and the outlet channel from which the first material is discharged, a second valve, wherein the second valve is operatively fluidly connected to the second reservoir, wherein the second valve is hand actuable between a second valve open state and a second valve closed state, wherein in the second valve open state the second valve is operative to discharge the second material to a cleaning channel, wherein the cleaning channel is operatively fluidly connected to the mixing chamber, wherein in the first valve closed state the mixing chamber is fluidly separated from the first reservoir and is in fluid communication with the cleaning channel, wherein in the second valve open state and in the first valve closed state, the second material is discharged through the first valve, whereby the first material is cleaned from the first valve and the mixing chamber by the discharged second material.

22. Apparatus comprising:

an aerosol valve system including a first reservoir, and a second reservoir wherein the first reservoir is fluidly separated from the second reservoir, wherein the first reservoir houses a first material, and the second reservoir houses a second material that is different from the first material and which acts as a cleaning agent with respect to the first material, a first valve, wherein the first valve is selectively changeable between a first valve open state and a first valve closed state, wherein the first valve is operatively fluidly connected with the first reservoir, wherein the first valve includes a first valve stem, wherein the first valve stem includes an outlet channel, wherein the first valve is operative to discharge the first material through the outlet channel when the first valve is in the first valve open state, a mixing chamber, wherein the mixing chamber is fluidly intermediate of the first reservoir and the outlet channel, a second valve, wherein the second valve is selectively changeable between a second valve open state and a second valve closed state, wherein the second valve is operatively fluidly connected with the second reservoir, a cleaning channel, wherein the second valve is in operative fluid connection with the cleaning channel and is operative to discharge the second material to the cleaning channel in the second valve open state, wherein the cleaning channel is in operative fluid connection with the mixing chamber of the first valve, wherein in the first valve open state, the first valve is operative to discharge the first material through the outlet channel, and wherein with the first valve in the first valve closed state and with the second valve in the second valve open state, the second material flows from the second reservoir to the mixing chamber through the cleaning channel and is discharged through the outlet channel, wherein the second material is operative to clean the first material from the mixing chamber and the outlet channel.

* * * * *